US007373740B2

(12) United States Patent
Lo

(10) Patent No.: US 7,373,740 B2
(45) Date of Patent: May 20, 2008

(54) INNOVATIVE SHAPED MEMORY INSOLE STRUCTURE WITH RE-ADJUSTABLE SUPPORTING PADS

(76) Inventor: Ming-Jor Lo, 11F-4, No. 197, Nanking East Road, Sec 4, Taipei (TW)

( * ) Notice: Subject to any disclaimer, the term of this patent is extended or adjusted under 35 U.S.C. 154(b) by 386 days.

(21) Appl. No.: 11/166,068

(22) Filed: Jun. 27, 2005

(65) Prior Publication Data

US 2006/0288613 A1 Dec. 28, 2006

(51) Int. Cl.
*A43B 23/00* (2006.01)

(52) U.S. Cl. ..... 36/44; 36/160

(58) Field of Classification Search ..... 36/43, 36/44, 154, 155, 160, 164; 12/142 N
See application file for complete search history.

(56) References Cited

U.S. PATENT DOCUMENTS 1,733,678 A * 10/1929 Torchia ..... 36/164
2,205,091 A * 6/1940 Geffner ..... 36/101
2,732,636 A * 1/1956 Amico ..... 36/160
4,813,157 A * 3/1989 Boisvert et al. ..... 36/44
4,819,644 A * 4/1989 Cherniak ..... 36/155
4,841,648 A * 6/1989 Shaffer et al. ..... 36/43
5,799,414 A * 9/1998 Kellerman ..... 36/44
6,000,147 A * 12/1999 Kellerman ..... 36/44
6,205,685 B1 * 3/2001 Kellerman ..... 36/44
6,510,626 B1 * 1/2003 Greenawalt ..... 36/43
7,210,250 B2 * 5/2007 Gallegos ..... 36/44

* cited by examiner

*Primary Examiner*—Marie Patterson
(74) *Attorney, Agent, or Firm*—Rosenberg, Klein & Lee

(57) ABSTRACT

An innovative shaped memory insole with re-adjustable supporting pads, an insole structure that can be tailor made on the spot, and thereafter can be repeatedly reshaped through a processes of non-destructive structural re-adjustment and free of glue to do re-assembly, using a design of re-adjustable structural supporting pads and a shape memory insole to meet the needs of different foot pressures on the user, thereby alleviating pain to the user's feet, providing stability to the user's ankles and improving the balance of the lower limbs.

1 Claim, 9 Drawing Sheets

INNOVATIVE SHAPED MEMORY INSOLE STRUCTURE WITH RE-ADJUSTABLE SUPPORTING PADS

BACKGROUND OF THE INVENTION

1. Field of the invention

The present invention relates to an innovative shape memory insole structure with re-adjustable support pads, in particular an insole structure that can be tailor-made on the spot, and thereafter, the configured insole can be repeatedly reshaped through the process of non-destructive structural re-adjustment and free of glue to do re-assembly.

2. Description of the Prior Art

According to textbooks on physical therapy, more than 80% of people have suffered from foot problems. To address such problems, gait analysis can be conducted by measuring the foot pressures on patient's foot. The results of the evaluation can be used to design biomechanical insoles to suit our feet.

The foot contains 28 bones, the 7 tarsal and 5 metatarsal bones to form three arches, which include the medial and lateral longitudinal arches and the transverse arch. These three arches can provide supportive strength to stance and absorb the impact force to foot. Foot disorders or sustained irregular walking posture can result the excessive loosening or tightening of foot muscles, tendons, ligaments, and bones joints. It will cause the abnormal development of foot arches, fatigue, injury, and inflammation, and also have a negative effect on the knees, pelvis, spine, and shoulders. The main function of the tailor-made insole lies in the design of the insole's structural support providing proper support to the three arches and increasing the contact surface area between the insole and the foot, thus reducing peak pressure off.

However, after wearing a conventional tailor-made insole for a period of time, the soft tissue of foot sometimes changes to fit the structure of the insole. Therefore, when you wear a tailor-made insole, you need regular follow-up examinations and adjustments of the insole. Conventional tailor-made insoles can not be easily adjusted after their shapes are fixed. In case its structural support needs to be adjusted, it can be time and cost consuming, as this would require ordering the production of a new one.

Besides, a conventional insole is only a foot-shaped flat pad, using foam materials to support stance force to the feet and absorb impact force. However, because it lacks proper structural support or shock-absorbing capability for the insole, it cannot meet the requirements of people with irregular foot pressure, nor satisfy the customer's requirements for comfort and health to their feet.

In view of the above areas that need improvement in order to satisfy the requirements of people with irregular foot pressure and improve walking comfort and health, the present inventor has conducted repeated research and experiments, and has come up with a structure with innovative performance.

For better understanding of the structure, approach, objectives, and spirit of the present invention, please refer to the following description and drawings.

SUMMARY OF THE INVENTION

The invention relates to an innovatively structured shaped memory insole with re-adjustable support pads, in particularly an insole structure that can be tailor-made on the spot, and can be thereafter repeatedly reconfigured through the process of non-destructive structural re-adjustment and free of glue to do re-assembly.

DETAILED DESCRIPTION OF THE PREFERRED EMBODIMENT

Figure 1:
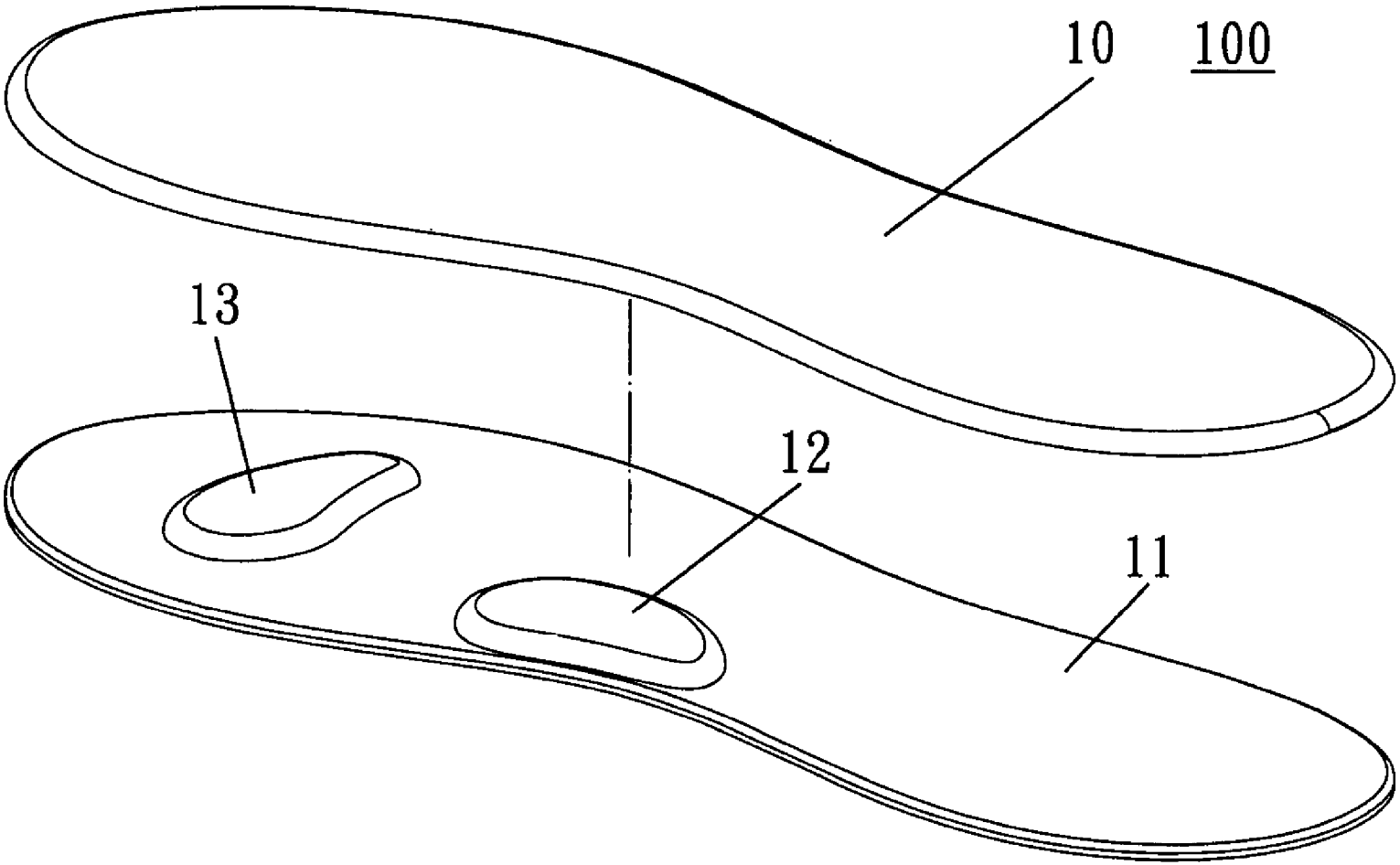
FIG. 1 is an exploded view of the shaped memory insole invention.

The invention relates to an innovatively structured shaped memory insole with re-adjustable supporting pads (FIG. 1), comprised of a structure bottom board (11), a memory insole (10), and supporting pads (12,13). Attached to the surface of the bottom board (11), the bottom layer of the memory insole (10), and the supporting pads (12,13) are velcro strips for fastening purposes.

Figure 2:
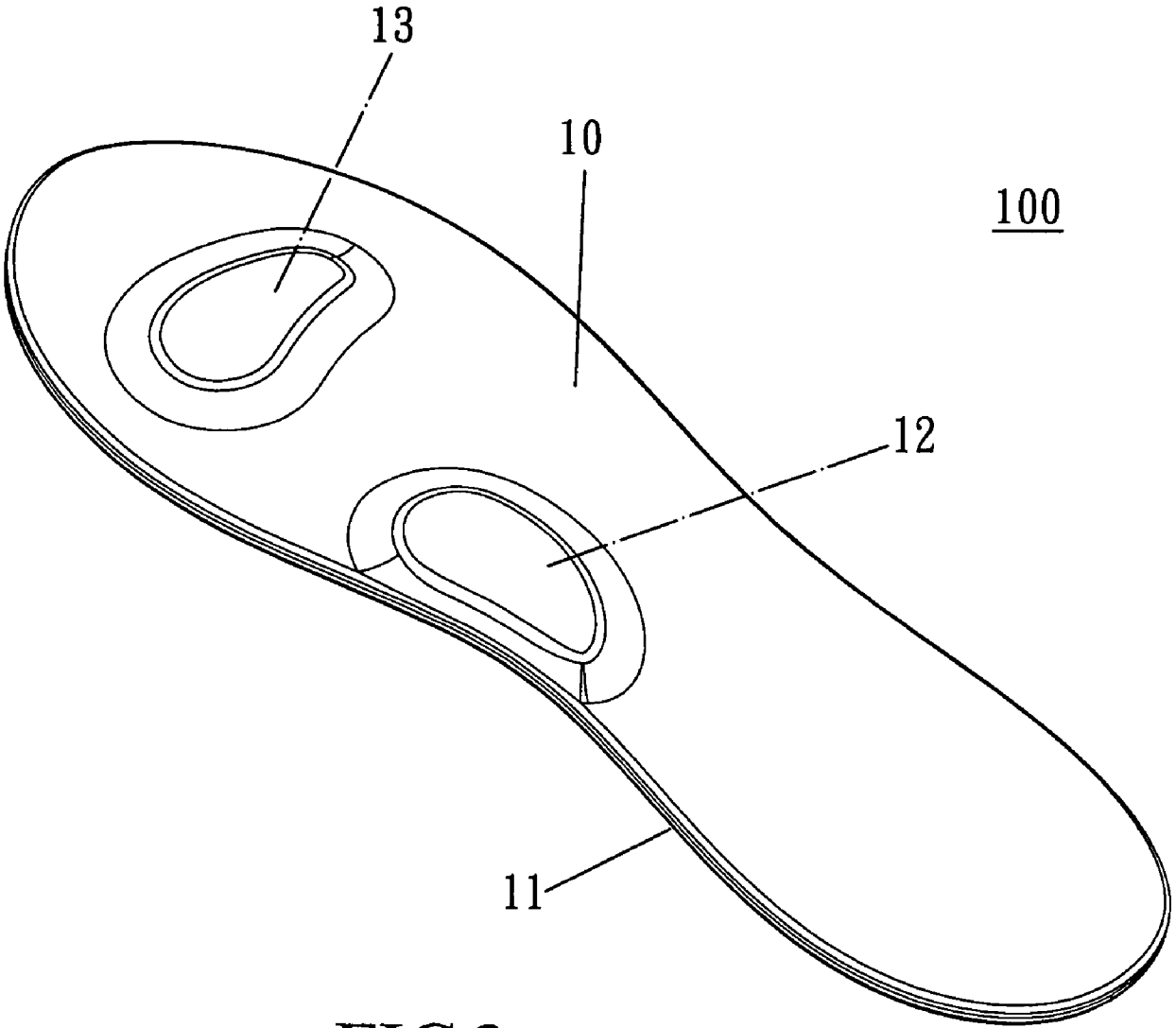
FIG. 2 is a perspective view of the present shaped memory insole invention.
Figure 3:
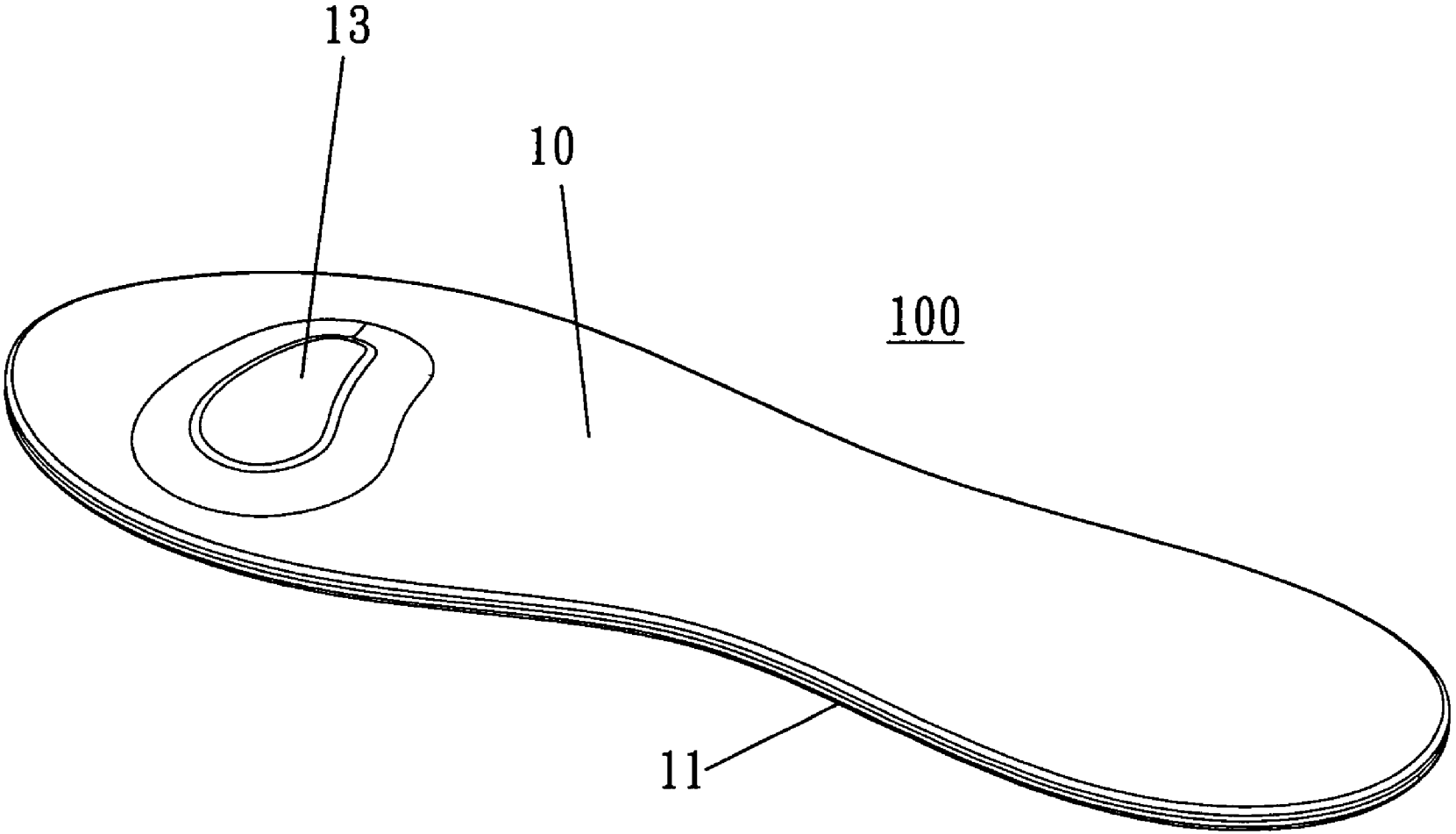
FIG. 3 is a perspective view of another preferred embodiment of the present shaped memory insole invention.
Figure 4:
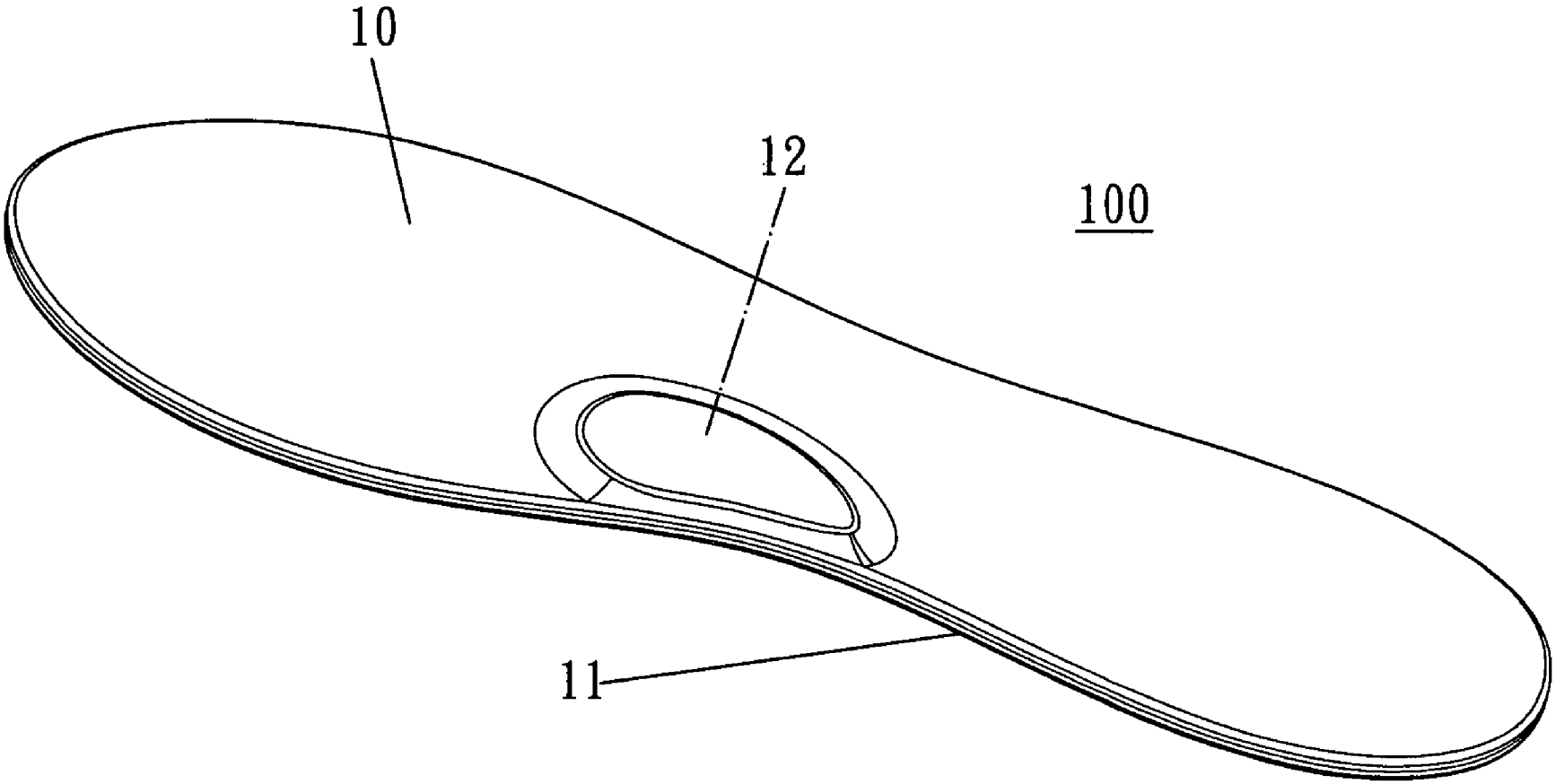
FIG. 4 is a perspective view of yet another preferred embodiment of the present shaped memory insole invention.

Wherein, at appropriate locations as required, the supporting pads (12,13) are attached to the foot arch and memory insole (10) and the bottom board (11), then the memory insole (10) and the bottom board (11) are combined together to form a shaped memory insole (100) (refer to FIGS. 2, 3 and 4).

Figure 1A:
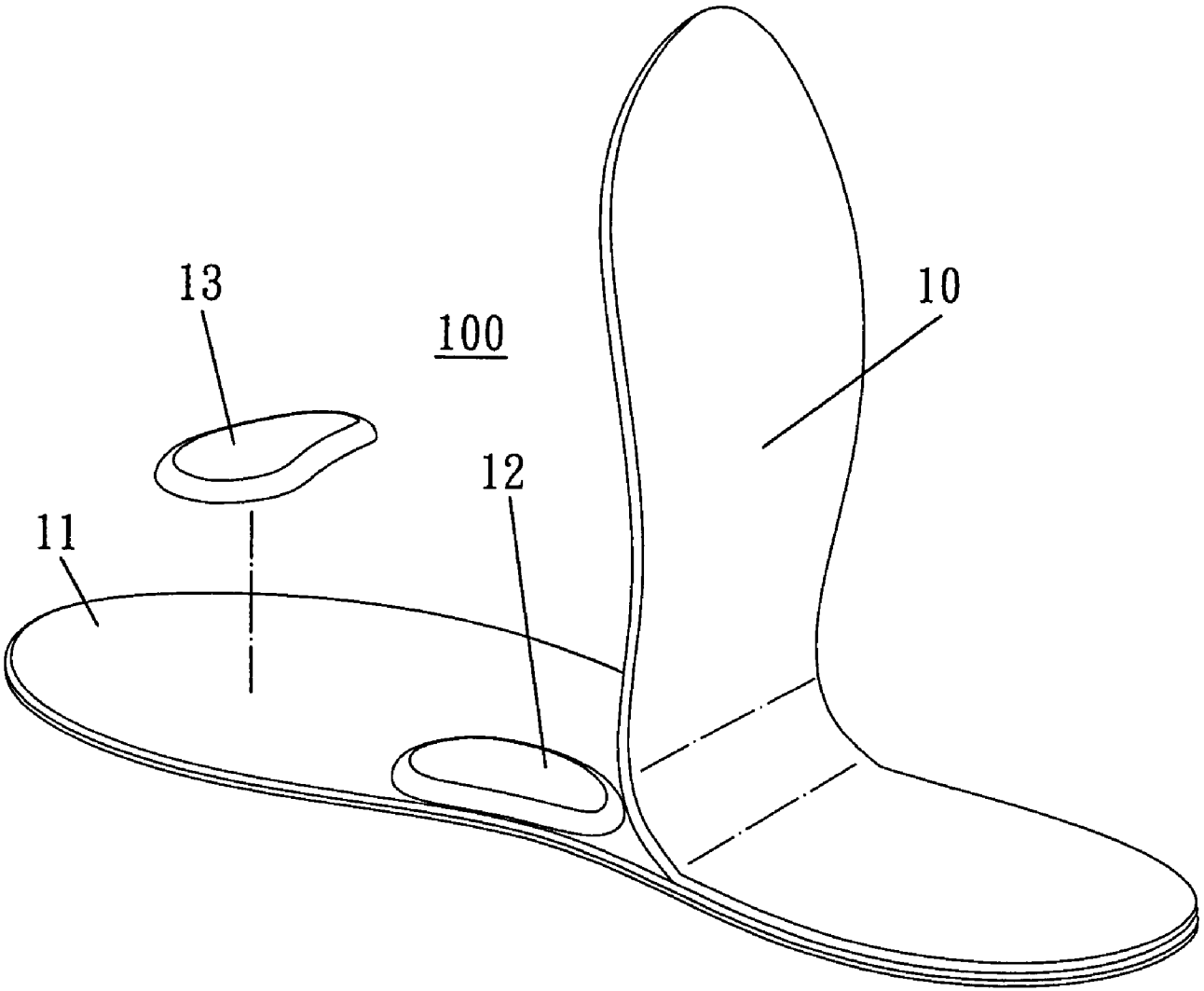
FIG. 1A is an exploded view of another preferred embodiment of the present shaped memory insole invention.

FIG. 1A is a perspective view of another embodiment of the shaped memory insole. As shown, the rear of the bottom board (11) and the memory insole (10) are combined and fastened to form an opening. In the opening, velcro strips are attached to the bottom board (11) and the memory insole (10). The supporting pads (12,13) are fastened to appropriate locations as required on the bottom board (11) and the memory insole (10). The memory insole (10) is then pressed down to form a shape memory insole (10) (refer to FIGS. 2, 3 and 4).

Wherein, the memory insole (10) is made of a thermoplastic memory foam material, having such characteristics as shock absorption, resistance to deformation by compressive force, resistance to damage, and the ability of permanent formation after being subjected to the thermoplastic process.

As shown in FIGS. (2, 3, and 4), the supporting pads (12,13) are distributed at different locations between the memory insole (10) and the bottom board (11) of the shaped memory insole (100), forming different projections of support.

Figure 6:
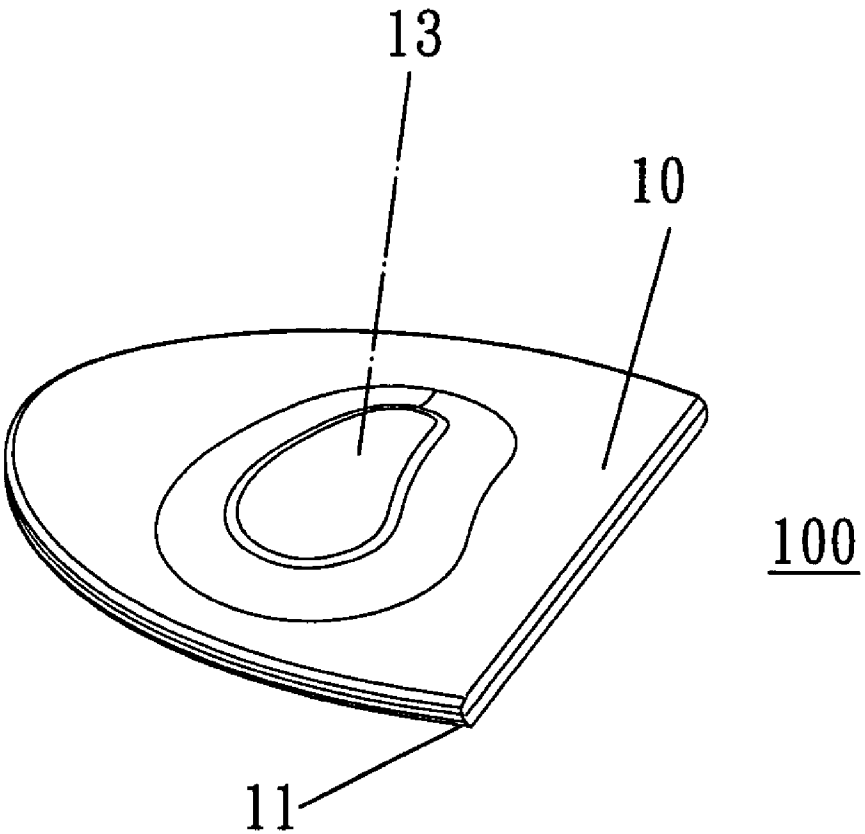
FIG. 6 is a perspective view of a further preferred embodiment of the present shaped memory insole invention.

FIG. 6 shows an optional design for the shaped memory insole 100 in the configuration of a regional insole structure.

Figure 7A:
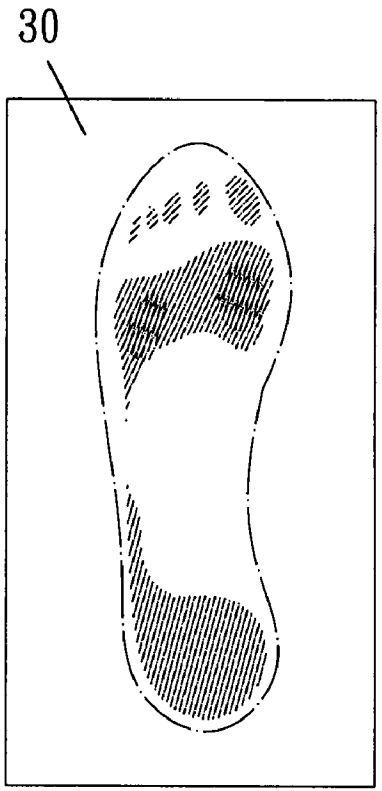
FIG. 7A is a view of foot pressure areas on a sole.
Figure 7:
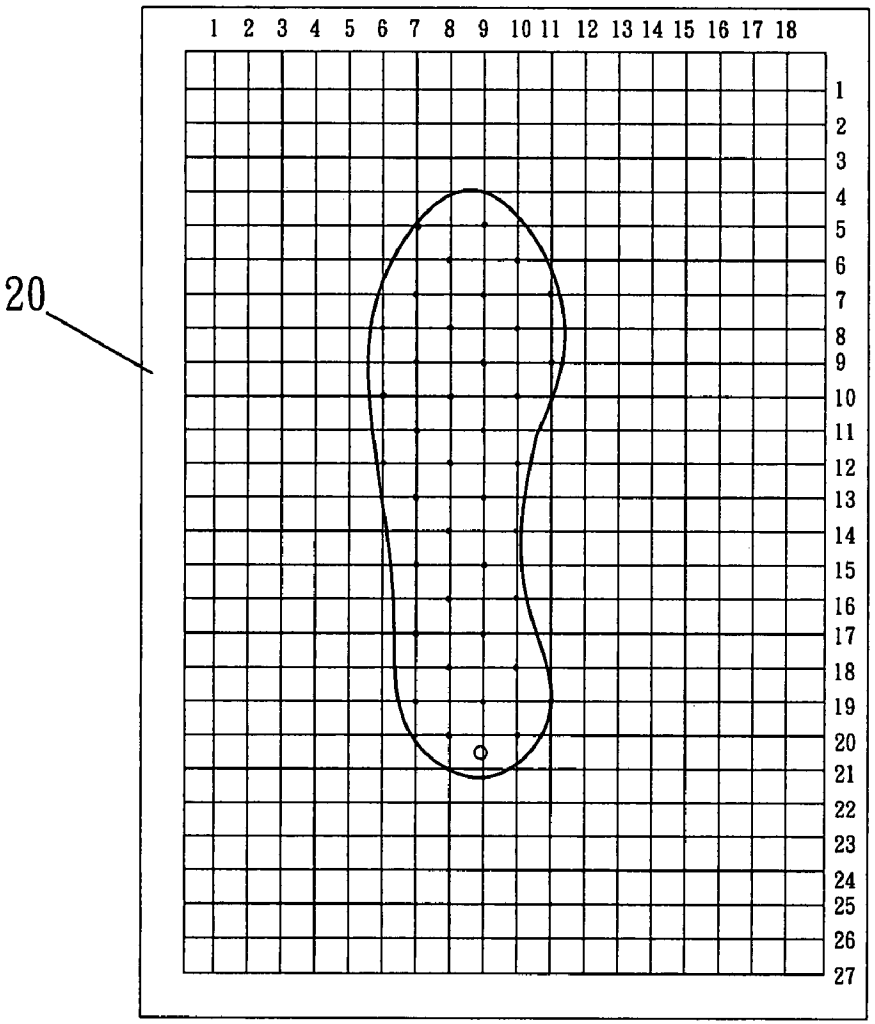
FIG. 7 is a view of a coordinate position film of the present invention.

FIG. 7 shows a view of the invention's coordinate position film. It is a transparent film (applicable for both left and right legs) printed with a memory insole outline and crossing positioning lines forming a grill pattern. The crossing points of the grille can be optionally provided with through holes marked with different corresponding signs to facilitate reading for determining position and marking position indicators on the memory insole (10).

Figure 5:
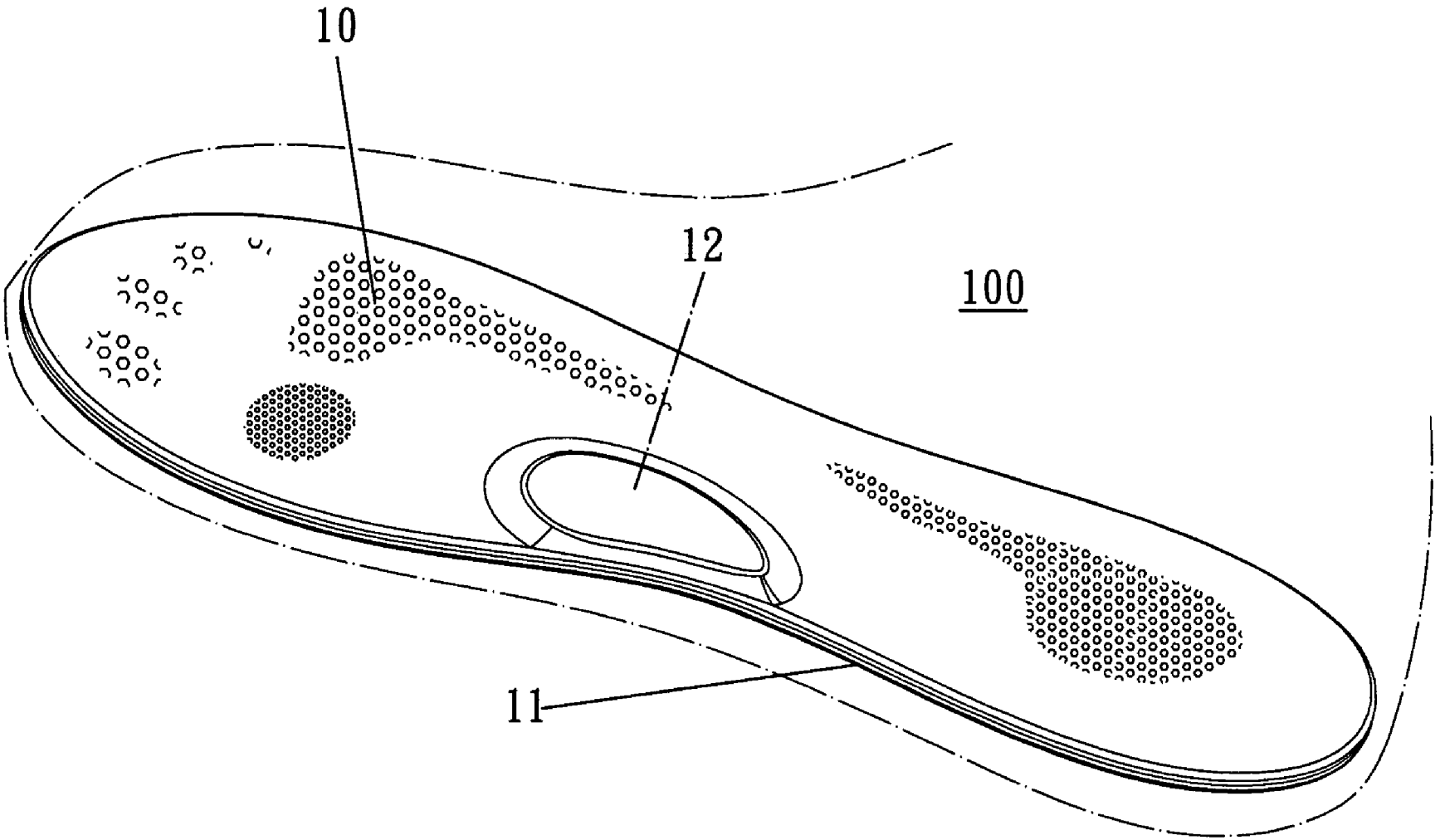
FIG. 5 is a perspective view of the present shaped memory insole invention when it is positioned inside a shoe.

As shown in FIG. 5, showing the shaped memory insole in use, wherein the shaped memory insole (100) is positioned inside a shoe. A hair dryer (at a temperature of 65° or higher) is then used to blow hot air for several minutes on the memory insole 10 of the shaped memory insole 100. After its surface has gradually softened, the user puts the foot inside the shoe and stands up for several minutes. When the temperature of the memory insole's (10) surface drops, it hardens into a fixed shape, with its surface showing a structural figure matching the user's sole. Thereby, the three arches on the user' sole have proper support and the area of contact between the insole and the user's sole is increased, having the effect of reducing peak foot pressure.

Furthermore, the shape memory insole's (100) memory insole (10) is re-adjustable. By heating the memory insole (10) with a hair dryer, the memory insole (10) will resume its original shape; so when another user puts his or her foot inside the shoe and stands for a while, waiting for it to cool down, a new shape will be imprinted thereon.

Moreover, in case the user should feel that the positions of the support pads (12,13) positioned on shape memory insole (100) are uncomfortable in their foot support, the user can pull apart the memory insole (10) and the bottom board (11) to fine-tune the location of the supporting pads (12,13), then combine and fasten the memory insole (10) to the bottom board (11) for re-heating and re-shaping.

Figure 8:
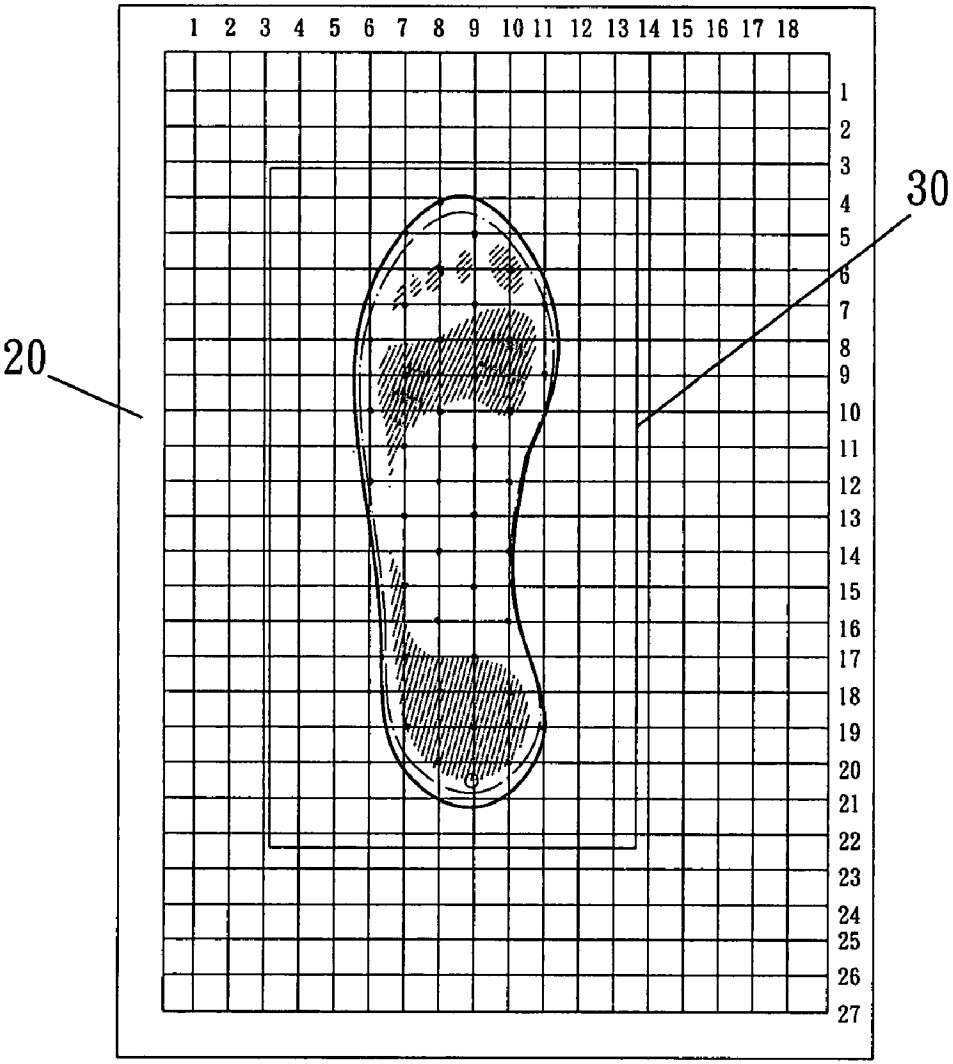
FIG. 8 is a view of an overlapped coordinate position film and foot pressure test report either foot pressure test piece for judgment of supporting pad position.

To determine the precise location of the supporting pads (12,13), the user may inquire a skilled professional man to use foot print mat or foot pressure test piece to imprint a figure of foot pressure (30) (FIG. 7A), then overlap it with the positioning film (20), to define the positions of using the grille and signs of the positioning film (20) (FIG. 8), then overlap the positioning film (20) and the bottom board (11) to locate the positions of the supporting pads (12,13), and insert and fasten the supporting pads (12, 13).

As described above, the pads are capable of achieving their anticipated performance, and has not yet been released for public use, and is satisfactory to the requirements of applicability and novelty. Therefore this application is duly filed for a patent right. Your favorable consideration shall be appreciated.

It is to be understood that the above is detailed description of the invention's preferred embodiments, and that all modifications or variations are made without departing from the spirit of the above description, and drawings shall be included in the subject claim.

What the invention claimed is:

1. An innovatively structured shaped memory insole with re-adjustable supporting pads, comprising:

a plastic structural bottom board;

a memory insole disposed on the bottom board;

at least two supporting pads disposed between the memory insole and the bottom board at selected locations; and a transparent film for identifying the locations of the supporting pads;

wherein a surface layer of the bottom board, a bottom layer of the memory insole, and a bottom layer of each of the supporting pads are provided with respective portions of hook and pile fastener strips for fastening the supporting pads and memory insole to the bottom board, the supporting pads being attached to selected positions on the bottom board, the memory insole being attached to the bottom board to form a foot shape memory insole; wherein when re-adjusting the foot shape memory insole the rear of the bottom board and the memory insole remain respectively fastened each to the other, a forward portion of the memory insole is unfastened from the bottom board, the supporting pads being relocated to be fastened at newly selected locations on the bottom board, and then the forward portion of the memory insole is pressed to the bottom board to secure one to the other and form a foot shape memory insole;

wherein the memory insole is made of a foam thermoplastic memory material, having the characteristics of shock absorption, resistance to deformation by compressive force, resistance to damage, and a fixed shape when not subjected to heat, when subjected to heat, surfaces of the memory insole soften assuming a contour matching a user's sole when compressed by the user's weight and subsequently hardens into the fixed shape that mirrors a contour of the user's sole when the surface temperature cools, and when heated in the absence of any applied compressive force the memory insole resumes its original shape;

wherein the transparent film is printed with a foot outline and crossing positioning lines in a grid pattern for use with the memory insole, the crossing points in the grid being provided with through holes and different corresponding signs, to facilitate reading and making marks on the memory insole for selecting the locations the supporting pads.

* * * * *